United States Patent [19]

Waller

[11] 4,145,013

[45] Mar. 20, 1979

[54] SLITTING MACHINE CLAMPING ASSEMBLY

[76] Inventor: Donald F. Waller, 730 Hanover Rd., Meriden, Conn. 06450

[21] Appl. No.: 851,347

[22] Filed: Nov. 14, 1977

[51] Int. Cl.[2] ..... B65H 75/28

[52] U.S. Cl. ..... 242/74.1; 242/78.1

[58] Field of Search ..... 242/74.1, 74.2, 78.1, 242/78.3, 74

[56] References Cited

U.S. PATENT DOCUMENTS

| | | | |
|---|---|---|---|
| 1,183,044 | 5/1916 | Shampay | 242/74.1 |
| 2,256,400 | 9/1971 | Matthews | 242/78.1 |
| 3,167,270 | 1/1965 | Jones | 242/74.1 |

*Primary Examiner*—Edward J. McCarthy

[57] ABSTRACT

A clamping assembly, operable for securing a predetermined portion of a strip of material to a cylindrical member at a selected position on the circumference thereof, comprising an actuatable clamping means movably mounted on the cylindrical member in juxtaposed relation to the selected position on the circumference thereof, resilient means positioned so as to be cooperable with the actuatable clamping means, and actuating means engageable with the actuatable clamping means for effecting the movement of the actuatable clamping means to cause the predetermined portion of the strip of material to be securely gripped with the resilient means serving to compensate for any irregularities which may exist in the clamping means, the cylindrical member and the predetermined portion of the strip of material.

14 Claims, 4 Drawing Figures

SLITTING MACHINE CLAMPING ASSEMBLY

BACKGROUND OF THE INVENTION (1) Field of the Invention

My invention relates to clamping assemblies, and more particularly to an improvement in clamping assemblies of the type employed with slitting machines.

(2) Description of the Prior Art

It has long been known in the prior art to employ clamping means to secure material to a particular surface. Moreover, it has likewise been known in the prior art that the selection of a particular form of clamping means for use in a given application is commonly predicated upon a consideration of many factors. For example, the nature and/or form in which the material exists will influence the selection of the clamping means. Secondly, consideration must be given to the kind of surface to which it is desired to clamp the material. Thirdly, the purpose for which the material is required to be clamped to the surface must be taken into consideration.

With further reference to the factors noted above, obviously a different form of clamping means would generally need to be employed where the material sought to be clamped is paper as compared for instance to where the material being clamped is sheet metal. Similarly, material in sheet form commonly necessitates the use of a different type of clamping means than that which would be employed if the material is in the form of a coil.

As concerns the kind of surface to which the material is to be clamped, clearly the conditions which must be met in order to ensure that the material is securely clamped to the surface will vary depending not only on the particular nature and/or form of the material as discussed in the preceding paragraph, but also depending on the nature of the clamping surface itself. For example, where a substantial portion of the material is to be clamped in engagement with the surface, it is commonly found to be relatively easy to effect the establishment of a secure connection therebetween. On the other hand, it is generally found to be much more difficult to establish a secure connection between a piece of material and a surface where only point contact exists therebetween, as for instance in a situation wherein one end of a sheet of material is sought to be clamped in tangential relation to the circumference of a circular or cylindrical member.

Many times it is found that the purpose for which the material is required to be clamped to the surface will influence the type of clamping means which is selected for use, more so than will a consideration of either the nature and/or form of the material, or the kind of surface to which the material is to be clamped. Namely, if the purpose for which the material is being clamped to the surface is simply to effect the retention of one end of the material to the surface, while the material, for example, is being coiled about the surface, very little consideration must be given to utilizing a clamping means which would be capable of preventing relative movement between the clamped portion of the material and the clamping surface. In the case, however, where the material is being clamped to the surface in connection with the performance of some form of machining operation on the material, there exists an obvious need to ensure that no relative movement is permitted to take place between the material and the surface once the former has been clamped to the latter. Otherwise, the machining operation sought to be performed on the material will not be effected in the desired manner.

As noted above, clamping means are commonly employed in a variety of different applications. One such application involves the clamping of one end of a strip of material to a cylindrical member. More specifically, the one end of the strip of material is inserted into an elongated slot formed in the circumference of the cylindrical member and extending substantially the length thereof. The purpose of effecting the clamping of the end of the strip of material to the cylindrical member is to enable a slitting operation to be performed on the strip of material. It is imperative that the end of the strip of material be securely clamped in order to ensure that no relative movement occurs between the product and the cylindrical member, which could affect the precision with which the slit is made.

It has been known in the prior art to provide a clamping assembly which is operable to effect the clamping of a sheet which has a portion thereof inserted into a slot formed in the surface of a reel. Biggert et al U.S. Pat. No. 1,603,017 and Matthews U.S. Pat. No. 2,256,400 are believed to be representative of such prior art. However, such prior art clamping assemblies have suffered by and large primarily from the disadvantage that they were relatively complex in nature and relatively difficult to employ. Moreover, such prior art assemblies proved to be less than satisfactory when placed in operation insofar as concerns their capability to prevent relative movement between the material and the cylindrical or circular member from occuring. Most importantly, however, such prior art clamping assemblies proved to be deficient insofar as concerns their capability to compensate for the existence of irregularities in the surfaces of the material, the cylindrical or circular member, and the clamping means. The importance of being able to compensate for such irregularities rests primarily in the fact that absent such compensation the clamped end of the material often exhibits a tendency to skew relative to the surface against which the material is being clamped. Such skewing in turn can affect the accuracy with which the slitting operation is performed. This has led to a need for a clamping means which although simple in construction would nevertheless be capable of effecting a reliable and secure clammping of the end of a strip of material to the surface of a cylindrical member. A further feature desired to be possessed by such a clamping means is that it embody the capability to compensate for irregularities which may exist in the surface of the material to be clamped, the surface to which the material is to be clamped, and the means operative to effect the clamping of the material to the surface, thereby serving to obviate the problem of skewing.

SUMMARY OF THE INVENTION

The present invention overcomes the above briefly discussed and other deficiencies and disadvantages of the prior art by providing a novel and improved clamping assembly. The clamping assembly of this invention is operable for securing a predetermined portion of a strip of material to a cylindrical member at a selected position along the circumference of the latter. In accordance with a preferred embodiment, the clamping assembly includes a hydraulically actuated clamp bar which is mounted on the cylindrical member at one side of a slot formed in the circumference of the cylindrical member. The hydraulically actuated clamp bar is operable to effect the retention of one end of the strip of material in the aforesaid slot.

A clamping assembly in accordance with a preferred embodiment of the present invention further includes a resilient member, for example a coil spring, which may be encased in silicone rubber. The resilient member may either be carried by the clamp bar or retained in the slot while being permitted to move relative thereto.

The clamping assembly in accordance with a preferred embodiment may also include hydraulic plungers which are operative to cause the clamp bar to be moved toward the opposite side of the slot to effect the gripping of the end of the strip of material which is positioned in the slot. The resilient member, for example a coil spring, will compensate for irregularities existing in the surface of the clamp bar and/or in the surface of the cylindrical member and/or in the end of the strip of material which is being clamped.

It is therefore an object of the present invention to provide a novel and improved clamping means for effecting the clamping of a portion of material to a surface.

it is another object of the present invention to provide such a clamping means which is operable to effect the clamping of one end of a strip of material to the surface of a cylindrical or circular member.

A further object of the present invention is to provide such a clamping means for use in clamping one end of a strip of material to the surface of a cylindrical or circular member, which is operable to prevent relative movement from occurring between the clamped end of the strip of material and the surface of the cylindrical or circular member to which the end of the strip of material is clamped.

A still further object of the present invention is to provide such a clamping means which is operative to securely retain one end of a strip of material in clamped engagement to the surface of a cylindrical or circular member while a slitting operation is being performed on the strip of material.

Yet another object of the present invention is to provide such a clamping means for use in clamping one end of a strip of material to the surface of a cylindrical or circular member which is capable of effecting a compensation for irregularities present in the surface of the end of the strip of material which is to be clamped, the circumference of the cylindrical or circular member to which the end of the strip of material is to be clamped, and the means through which the clamping of the end of the strip of material to the circumference of the cylindrical or circular member is effected.

Yet another object of the present invention is to provide such a clamping means for use in clamping one end of a strip of material to the circumference of a cylindrical or circular member, which is operative to prevent the clamped end of the strip of material from skewing relative to the surface of the cylindrical or circular member.

DESCRIPTION OF A PREFERRED EMBODIMENTS

Figure 1:
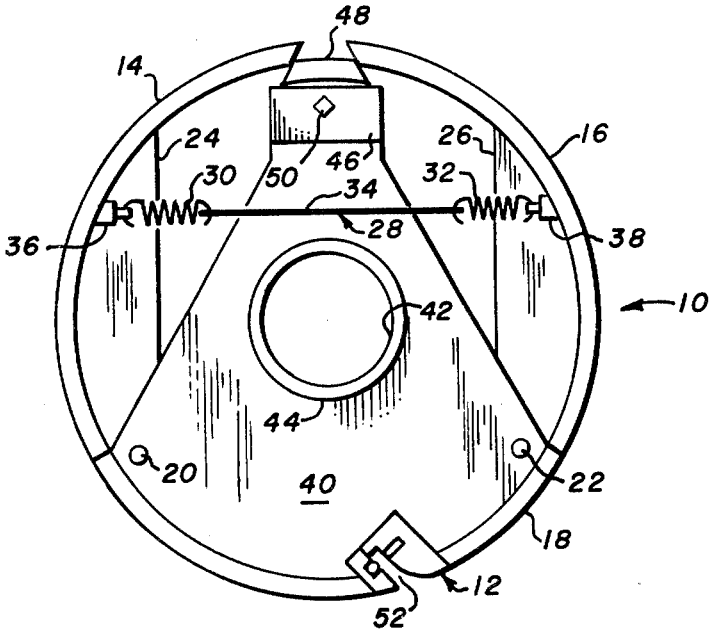
FIG. 1 is an end view of a portion of a slitting machine embodying a clamping assembly constructed in accordance with a first embodiment of the present invention.

Referring now to FIG. 1 of the drawing, there is illustrated therein a cylindrical member, generally designated by the reference numeral 10, which is commonly referred to as the reel or drum of a slitting machine (not shown). The reel or drum 10 embodies therein a novel and improved clamping assembly 12, constructed in accordance with the present invention. Inasmuch as the reel or drum 10, apart from the embodiment therein of the clamping assembly 12, is of conventional construction, only a brief description of the reel or drum 10 is deemed to be necessary for purposes of acquiring an understanding of the present invention.

As seen in FIG. 1, the reel or drum 10 includes three arcuate members 14, 16 and 18, which collectively operate to form the circumference of the reel or drum 10. In a manner yet to be described, the arcuate members 14 and 16 are each mounted so as to be movable relative to each other. More specifically, the arcuate member 14 is fastened adjacent to one end of the arcuate member 18 by means of a stud 20, so as to be pivotable thereabout relative to the arcuate member 18. Similarly, the arcuate member 16 is fastened adjacent to the other end of the arcuate member 18 by means of a stud 22, so as to be pivotable thereabout relative to the arcuate member 18. The studs 20 and 22, which are affixed to the arcuate members 14 and 16, respectively, pass through suitable openings (not shown) provided for this purpose in the arcuate member 18. After passing through the aforesaid openings (not shown), cotter pins (not shown) are preferably employed for purposes of maintaining the engagement of the studs 20 and 22, and thereby the arcuate members 14 and 16, respectively, with the arcuate member 18.

In accordance with the embodiment of reel or drum 10 depicted in FIG. 1, the arcuate members 14 and 16 are each provided with a strengthening member 24 and 26, respectively. The purpose of the members 24 and 26 is to provide additional strength to the arcuate members 14 and 16, respectively. The members 24 and 26 can be formed either as separate members which are subsequently secured to the arcuate members 14 and 16, respectively, such as by welding, or the members 24 and 26, if so desired, could be formed integrally with the arcuate members 14 and 16, respectively. Obviously, however, other means could be utilized to provide the desired additional strength to the arcuate members 14 and 16 without departing from the essence of the present invention.

The arcuate members 14 and 16 are interconnected by resilient means 28 so as to be biased towards each other for a purpose yet to be described. As illustrated in FIG. 1, the resilient means 28 includes a first coil spring 30, a second coil spring 32, and a thin, elongated member 34, which may take the form of a leaf spring. The first coil spring 30 has one end thereof secured to a stud 36 which is itself attached to the inner surface of the arcuate member 14. The other end of the coil spring 30 is secured to one end of the leaf spring 34, while the other end of the leaf spring 34 is secured to one end of the second coil spring 32. Finally the other end of the coil spring 32 is secured to a stud 38 which is in turn fastened to the inner surface of the arcuate member 16.

Continuing with a description of the reel or drum 10, the arcuate member 18 has a generally triangularly-shaped member 40 secured to the inner surface thereof. As depicted in FIG. 1, the member 40 is of sufficient length so as to substantially span the inner diameter of the reel or drum 10. The member 40 has an opening 42 formed therein so as to be located at the center of the reel or drum 10. The opening 42 is suitably dimensioned so as to be capable of receiving therein an axle (not shown) about which the reel or drum 10 may be made to rotate. For this purpose, the member 40 is preferably provided with a hub 44, in which the axle (not shown) is received. Means (not shown) such as for example, a set screw, is also preferably provided for purposes of interconnecting the hub 44 to the axle (not shown), whereby rotation of the axle (not shown) will be transmitted to the hub 44 and therethrough to the reel or drum 10 so that the axle (not shown) and the reel or drum 10 rotate together as a unit.

At its narrow, i.e., free end, the member 40 has formed thereon a substantially rectangularly-shaped member 46. The latter member 46 has a wedge-shaped member 48 supported thereon for movement relative thereto. More specifically the wedge-shaped member 48 is connected in a conventional manner (not shown) to a ratchet member 50 so as to be movable towards, i.e., to a retracted position, and away from i.e., to an extended position, the member 46. Such movement of the wedge-shaped member 48 is effected preferably by causing the rotation of the ratchet member 50. The latter ratchet member 50 is suitably dimensioned so as to be capable of receiving thereon a manually operable crank (not shown), which can be utilized to apply a rotative force to the end of the ratchet member 50, which in turn is translated into a linear motion of the wedge shaped member 48. As the wedge-shaped member 48 is caused to move outwardly away from the member 46, the wedge-shaped member 48 moves between the ends of the arcuate member 14 and 16 causing the latter to move away from each other against the bias of the resilient means 28. In its fully extended position, the wedge-shaped member 48 fills the space between the arcuate members 14 and 16 so as to form a constinuation of the circumference of the reel or drum 10.

Referring once again to FIG. 1 of the drawing, as depicted therein the clamping assembly 12 in accordance with the present invention is mounted in the outer surface of the arcuate member 18. More specifically, the arcuate member 18 has formed therein a slot 52 extending the length of the reel or drum 10. The clamping assembly 12 in a manner now to be described is supported within the slot 52.

Figure 2:
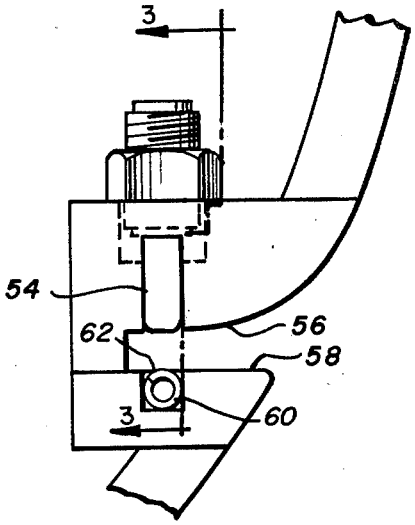
FIG. 2 is an end view on an enlarged scale of the clamping assembly of FIG. 1.

As will now be described particularly with reference to FIGS. 2 and 3 of the drawing, the clamping assembly 12 includes an elongated clamp bar 54. The latter clamp bar 54 is movably mounted in one of the side walls 56 of the slot 52 so as to be extendable and retractable relative to the slot 52 in a manner which will be subsequently described herein. Supported in the other side wall 58 of the slot 52 in opposing relation to the clamp bar 54 is a coil spring 60. In accord with the preferred embodiment of the invention, the side wall 58 of the slot 52 is preferably notched at 62 so as to receive and retain the coil spring 60 therein. Moreover, the coil spring 60 is preferably encased in a coating 64 of silicone rubber.

Figure 3:
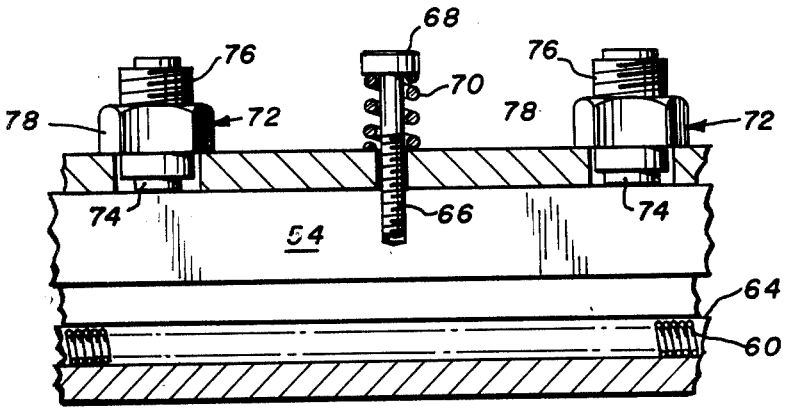
FIG. 3 is a side elevational view on an enlarged scale of the clamping assembly of FIG. 1.

As best understood with reference to FIG. 3, the clamp bar 54 is supported within the side wall 56 of the slot 52 by means of one or more fasteners 66. The latter fastener 66 has the threaded end thereof threaded into the clamp bar 54. For this purpose, it is to be understood that a suitable opening is provided in the side wall 56 to permit the passage therethrough of each fastener 66. The other end, i.e., the head 68 of the fastener 66 serves as a seat for one end of a spring 70 which surrounds the shaft of the fastener 66. The other end of the spring 70 rests against the surface of the side wall 56. Consequently, the spring 70 is operative to bias the clamp bar 54 to a retracted position relative to the slot 52, i.e., to the position of the clamp bar 54 depicted in FIGS. 1, 2 and 3 of the drawing. It is to be understood that each fastener 66 would preferably be provided with a spring 70 in the manner of the fastener 66 which is illustrated in FIG. 3.

Referring again to FIGS. 2 and 3 of the drawing, the clamping assembly 12 further includes hydraulic means 72 cooperatively associated with the clamp bar 54 and operative to effect the movement of the clamp bar 54 to its extended position relative to the slot 52. The hydraulic means 72 consists of a multiplicity, i.e., two or more hydraulic actuators, i.e., plungers 74. Each of the hydraulic plungers 74 is supported for movement within an opening provided for this purpose in the surface of the side wall 56 so as to be in abutting engagement with the clamp bar 54. Each plunger 74 in turn is mounted within a cylinder 76 in a manner well known to those skilled in the art. In addition, as shown in FIG. 3 each cylinder 76 is maintained in mounted position relative to the surface of the side wall 56 by means of a suitable retainer 78. As will be described more fully hereinafter, each plunger 74 in response to a suitable level of hydraulic pressure being present in the corresponding cylinder 76 is caused to move outwardly relative to the cylinder 76, an concomitantly applies a force against the clamp bar 54 causing the latter to move outwardly away from the side wall 56 against the bias being applied thereto by the spring 70 which surrounds each fastener 66.

The manner in which the clamping assembly 12 functions in accordance with the preferred form of the invention to clamp one end of a strip of material in the slot 52 of a reel or drum 10 is best exemplified in the description which follows hereinafter. For the purposes of this description, it is to be understood that the cylinders 76 are each connected by suitable means (not shown) to a controllable source of hydraulic fluid capable of causing a buildup of hydraulic pressure to occur in the cylinders 76. With the clamp bar 54, under the bias of spring 70 associated with each fastener 66, being held in its retracted position relative to the slot 52, i.e., in the position thereof illustrated in FIGS. 1, 2 and 3 of the drawing, an end of a strip of material is inserted into the slot 52 so that the end of the strip of material is effectively in abutting engagement with the bottom of the slot 52. Then, a buildup of hydraulic pressure in the cylinders 76 is caused to take place. In response to this buildup of hydraulic pressure in the cylinders 76, the plungers 74 associated with the latter are moved outwardly away from the cylinders 76. This outward movement of the plungers 74 is effective to also force the clamp bar 54 outwardly into the slot 52 and more particularly into engagement with the strip of material which is positioned within the slot 52. The effect of this movement of the clamp bar 54 is to cause the end of the strip of material to be gripped, i.e., clamped between the leading edge of the clamp bar 54 and the coil spring 60, which is retained in the notch 62.

It has been found that the clamping force being exerted on the end of the strip of material by the cooperative engagement of the clamp bar 54 and the coil spring 60 is sufficient to securely hold the end of the strip of material to prevent relative movement from occurring between the latter and the side walls 56 and 58 of the slot 52. The coil spring 60 also functions to serve another purpose. Namely, the coil spring 60 functions to compensate for any irregularities which may be present in the leading edge of the clamp bar 54, in the surfaces of the end of the strip of material with which the clamp bar 54 and/or the coil spring 60 are in contact, and in the side walls 56 and 58 of the slot 52 which might tend to influence the manner in which the clamp bar 54 and the coil spring 60 otherwise engage the end of the strip of material. As long as the hydraulic pressure in the cylinders 76 is of a sufficient magnitude to cause the plungers 74 to be extended outwardly to apply a clamping force to the end of the strip of material, the latter will be held securely clamped between the clamp bar 54 and the coil spring 60. To release, i.e., unclamp, the end of the strip of material, it is only necessary to effect a reduction in the magnitude of the hydraulic pressure within the cylinders 76 whereby the plungers 74 will once again move inwardly into the cylinders 76 under the influence of the bias being applied to the clamp bar 54 by the spring 70 associated with the fastener 66. Thus, it can be seen that the function of the spring 70 is that of a return spring. While the end of the strip of material is being held securely clamped in the slot 52 by the clamping assembly 12, the slitting of the strip of material, or any other operation of a similar nature may be performed on the strip of material coiled about the reel or drum 10, without fear that any relative movement and/or skewing of the strip of material will occur while such operation is taking place.

As concerns the mode of operation of the reel or drum 10, the latter as has previously been mentioned hereinabove, is intended to be suitably mounted on an axle (not shown) so as to be rotatable therewith. Thus, once the end of the strip of material has been clamped to the reel or drum 10 through the operation of the clamping assembly 12 of the present invention, in the manner described in the preceding paragraph, the reel or drum 10 may be suitably rotated so as to effect the coiling of the strip of material about the circumference of the reel or drum 10. To facilitate the removal of the coiled material from about the reel or drum 10 and/or the initial insertion of the end of the strip of material in the slot 52 and the clamping thereof through operation of the clamping assembly 12, the circumference of the reel or drum 10 may be descreased in size. More specifically, the wedge-shaped member 48, which in its fully extended position forms a continuation of the circumference of the reel or drum 10 may be moved to a retracted position by operation of the ratchet member 50. Namely, the ratchet member 50 can be rotated by means of a manually operated crank (not shown) to cause the wedge-shaped member 48 to move out of engagement with the arcuate members 14 and 16. With the wedge-shaped member 48 so positioned out of engagement with the arcuate members 14 and 16, the latter are biased into engagement with each other under the influence of the resilient means 28, thereby effecting a reduction in the circumference of the reel or drum 10, thereby making it easier to remove the coiled material from the reel or drum 10.

Figure 4:
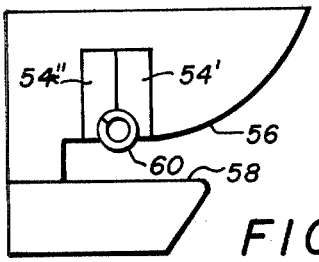
FIG. 4 is a schematic view of a second embodiment of a clamping assembly in accordance with the present invention.

Referring now to FIG. 4, a second embodiment of the present invention is depicted schematically. The embodiment of FIG. 4 differs from that of FIGS. 1—3 by virtue of the fact that the resilient member, specifically the coil spring 60, is carried by the clamp bar 54 and urges the end of the strip of material against the flat side of the slot in drum 10. In order to facilitate the manufacture and assembly of the clamp bar — spring assembly, the bar 54 is formed in two halves 54' and 54" which are subsequently bolted together. The facing outwardly disposed portions of the bar members 54' and 54" are milled to provide a recess which accepts spring 60. The recess in the clamp bar is commensurate in shape with the spring and extends about the spring a sufficient amount such that the spring will not fall out of the recess under the influence of gravity subsequent to the two halves of the clamp bar being bolted together; i.e., the spring receiving recess has a pair of opposite edges which overlap the spring to retain the spring in the clamp bar as shown. The embodiment of FIG. 4 otherwise functions in the samer manner as the embodiment of FIG. 1-3. The FIG. 4 embodiment, however, has been found to have the advantage of permitting easier removal of a coil of material from the drum.

Thus, in accordance with the present invention there has been provided a novel and improved clamping means for effecting the clamping of a portion of material to a surface. More specifically, the subject clamping means is operable to effect the clamping of one end of a strip of material to the surface of a cylindrical or circular member. In accord with the present invention, the clamping means is operable to prevent relative movement from occurring between the clamped end of the strip of material and the surface of the cylindrical or circular member to which the end of the strip of material is clamped. Thus, the clamping means of the instant invention is operative to securely retain one end of a strip of material is clamped engagement to the surface of a cylindrical or circular member while a slitting operation is being performed on the strip of material. Moreover, a clamping means has been provided in accord with the present invention which is capable of effecting a compensation for irregularities present in the surface of the end of the strip of material which is to be clamped, the circumference of the cylindrical or circular member to which the end of the strip of material is to be clamped, and the means through which the clamping of the end of the strip of material to the circumference of the cylindrical or circular member is effected, and as a consequence functions to also prevent the clamped end of the strip of material from skewing relative to the surface of the cylindrical or circular member. Finally, in accord with the present invention a clamping means has been provided which is relatively simple in construction, easy to employ, and relatively inexpensive to provide.

While only two embodiments of my invention have been shown, it will be appreciated that modifications thereof, some of which have been noted in the preceding description may readily be made by those skilled in the art. I therefore intend by the appended claims to cover the modifications specifically referred to herein as well as all other modifications which fall within the true spirit and scope of my invention.

What I claim as new and desire to secure by Letters Patent of the United States is:

1. A clamping assembly for securing a portion of a material to a member comprising:

clamping means movably mounted on the member, said clamping means including:

an elongated clamp bar;

fastener means having one end thereof fastened to said elongated clamp bar, the other end of said fastener means being movably supported on the assembly; and biasing means supported in enveloping relation to said fastener means for applying a biasing force to said elongated clamp bar;

resilient means cooperable with said clamping means; and actuating means engageable with said clamping means for effecting the movement of said clamping means to cause the portion of material to be engaged by said resilient means, said resilient means urging the portion of material against a non-yielding surface.

2. A clamping assembly as defined in claim 1 wherein said resilient means comprises a coil spring retained in a notch formed in said clamping means.

3. A clamping assembly as defined in claim 2, wherein said coil spring is encased in silicone rubber.

4. A clamping assembly for securing a portion of material to a member comprising:

clamping means movably mounted on the member;

resilient means operable with said clamping means, said resilient means comprising a coil spring retained in a notch formed in the member; and actuating means engageable with said clamping means for effecting the movement of said clamping means to cause the portion of material to be engaged by said coil spring, said coil spring urging the portion of material against a non-yielding surface and operating to compensate for any irregularities in the surfaces of the portion of the material or the non-yielding surface.

5. A clamping assembly as defined in claim 4 wherein said actuatable clamping means includes an elongated clamp bar.

6. A clamping assembly as defined in claim 4 wherein said coil spring is encased in silicon rubber.

7. A clamping assembly as defined in claim 6 wherein said actuating means further includes hydraulic cylinder means housing plunger means and having one end thereof connected in fluid flow relation with a hydraulic source, and retainer means mounting said hydraulic cylinder means on the member.

8. A clamping assembly as defined in claim 7 wherein said resilient means comprises a coil spring retained in a notch formed in said clamping means.

9. A clamping assembly as defined in claim 8 wherein said coil spring is encased in silicone rubber.

10. A clamping assembly for clamping one end of a strip of material in a slot formed in the circumference of a cylindrical member comprising:

an elongated clamp bar mounted in the slot for movement between a retracted position and an extended position relative to a first side of the slot, said clamp bar being provided with a recess in a surface which faces a second side of the slot which is oppositely disposed with respect to the first side of the slot;

resilient means mounted in the recess in said elongated clamp bar and carried by said bar; and hydraulically actuatable means engageable with said elongated clamp bar for effecting the movement of said elongated clamp bar towards the second side of the slot to cause the end of the strip of material to be securely gripped between said resilient means and the slot second side, said resilient means operating to compensate for any irregularities in the contacting surfaces of the end of the strip of material and/or the cylindrical member.

11. A clamping assembly as defined in claim 10 wherein said resilient means comprises a coil spring, said coil spring being encased in silicone rubber.

12. A clamping assembly as defined in claim 10 wherein said hydraulically actuatable means includes plunger means, hydraulic cylinder means and retainer means, said plunger means having one end thereof positioned in engagement with said elongated clamp bar, said hydraulic cylinder means housing said plunger means and having one end thereof connected in fluid flow relation with a hydraulic source, and said retainer means mounted said hydraulic cylinder means on the cylindrical member.

13. A clamping assembly as defined in claim 12 wherein said resilient means comprises a coil spring, said coil spring being encased in silicone rubber.

14. A clamping assembly for securing a portion of material to a member comprising:

clamping means movably mounted on the member;

resilient means cooperable with said clamping means; and actuating means engageable with said clamping means for effecting the movement of said clamping means to cause the portion of material to be engaged by said resilient means, said actuating means comprising hydraulically actuatable plunger means having one end thereof positioned in engagement with said clamping means, operation of said actuating means causing said resilient means to urge the portion of material against a non-yielding surface whereby said resilient means compensates for any irregularities in the surfaces of the portion of material or the non-yielding surface.

* * * * *

UNITED STATES PATENT AND TRADEMARK OFFICE

CERTIFICATE OF CORRECTION

PATENT NO. : 4,145,013

DATED : March 20, 1979

INVENTOR(S) : Donald F. Waller

It is certified that error appears in the above-identified patent and that said Letters Patent are hereby corrected as shown below:

Column 6, line 34, "an" should be --and--

Column 9, line 7, (Claim 1, line 9), "assembly" should be --member--

Column 10, line 33, (Claim 12, line 9), "mounted" should be --mounting--

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*